United States Patent [19]

O'Flanagan

[11] Patent Number: 4,538,784

[45] Date of Patent: Sep. 3, 1985

[54] SUPPORT ASSEMBLY FOR SHELVING

[75] Inventor: Michael O'Flanagan, Loughlinstown, Ireland

[73] Assignee: Institute for Industrial Research & Standards, Dublin, Ireland

[21] Appl. No.: 407,491

[22] Filed: Aug. 12, 1982

[30] Foreign Application Priority Data

Aug. 20, 1981 [IE] Ireland ..... 1913/81

[51] Int. Cl.[3] ..... A47G 29/02

[52] U.S. Cl. ..... 248/244; 108/108; 248/297.2

[58] Field of Search ..... 248/243, 235, 245, 246, 248/295.1, 244, 297.2; 211/187; 108/106, 107, 108, 110

[56] References Cited

U.S. PATENT DOCUMENTS

| | | | |
|---|---|---|---|
| 809,448 | 1/1906 | Kahn | 248/246 |
| 2,149,603 | 3/1939 | Hamby | 108/110 X |
| 3,181,923 | 5/1965 | Guillon et al. . | |
| 3,280,527 | 10/1966 | Faust | 248/243 X |
| 3,351,313 | 11/1967 | Guillow | 108/106 X |
| 3,502,293 | 3/1970 | Bard | 248/243 |
| 3,542,322 | 11/1970 | Dvorin | 248/632 |
| 3,848,844 | 11/1974 | Barrett | 108/106 X |

FOREIGN PATENT DOCUMENTS

| | | | |
|---|---|---|---|
| 15363 | 6/1912 | France . | |
| 1449289 | 10/1965 | France . | |
| 2428169 | 6/1978 | France . | |
| 144645 | 3/1954 | Sweden | 248/235 |
| 989083 | 4/1965 | United Kingdom | 248/243 |
| 1041622 | 9/1966 | United Kingdom | 248/246 |
| 1512777 | 6/1978 | United Kingdom | 248/245 |
| 2078098 | 1/1982 | United Kingdom . | |

*Primary Examiner*—J. Franklin Foss

*Attorney, Agent, or Firm*—Scully, Scott, Murphy & Presser

[57] ABSTRACT

A support assembly for shelving comprises a shelf supporting bracket having a rearwardly projecting tongue for interfitting in a complementary outwardly facing channelled groove in an upright. The bottom corner of the tongue is cut-away to form an upwardly extending slot for reception of a hollow cylindrical shaped body of resilient material which urges the lower portion of the tongue forwardly against the front face of the groove and prevents movement of the tongue along the upright.

In another aspect of the invention an elongate member is inserted into the slot at one end to push the tongue forwardly against the front face of the groove and at its other end rests on another shelf supporting bracket to fix the upper bracket in position relative the upright.

13 Claims, 14 Drawing Figures

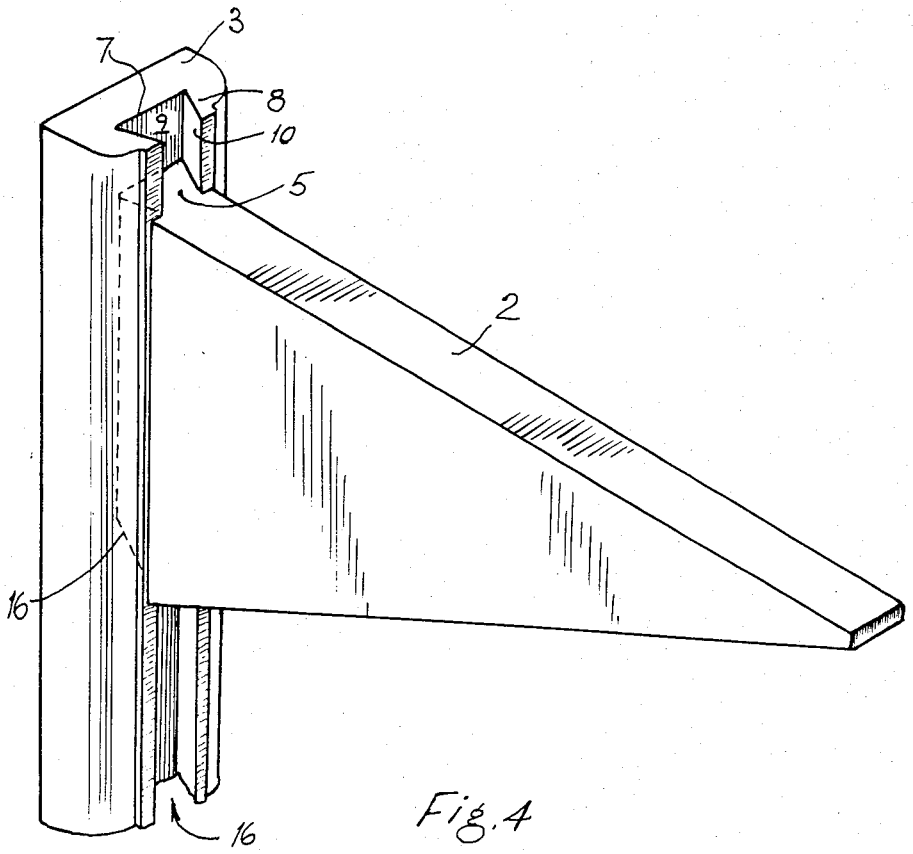
Fig. 4
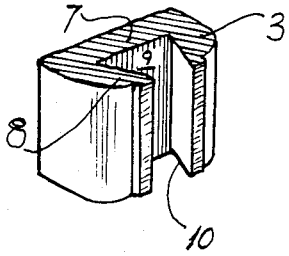

SUPPORT ASSEMBLY FOR SHELVING

BACKGROUND TO THE INVENTION

1. Field of the Invention

The present invention relates to a support assembly for shelving of the type comprising a shelf supporting bracket having a rearwardly projecting tongue for interfitting in a complementary outwardly facing channelled groove in an upright, the groove having spaced-apart front and rear retaining faces and in which the bracket is retained at a predetermined height in the upright.

2. Description of Prior Art

Support assemblies for shelving of this type are already known. One such assembly is shown and described in Danish Patent Specification No. 128977. This specification describes a support assembly for shelving comprising a shelf bracket having a side mounted male slide member for fitting into a H-section rail. A cranked wedge is provided for locking the slide member in the rail. The wedge is connected to the slide member by a coil spring extending between the top of the leg and the top of the slide member. When a downward loading force is applied to the shelf bracket the wedge is intended to react between the rail and the slide member to lock the slide in position in the rail.

This known assembly suffers from several disadvantages. Firstly, the wedge is particularly adapted to resist downward loading forces on the bracket and does not effectively resist sidewardly directed forces which tend to dislodge the slide member from the H-section rail. Further, because of the arrangement of the spring, height adjustment of the bracket relative the upright is difficult. The rail must be positioned so that it is possible to insert a gripping means into the rail to pull the spring upwardly to release the wedge and hence allow upward and downward movement of the slide member in the rail. Additionally, because the groove in the rail is visible when viewed from the side the support assembly is not acceptable in most applications from an aesthetic point of view.

Other support assemblies are known in which the shelf support bracket incorporates cam means which allow height adjustment of the bracket in one orientation and resist a downward load applied to the bracket in another orientation. Generally retaining means in addition to the cam members are required to maintain the brackets in position. In some cases these retaining means comprises a ledge formed on the rear of the bracket and engagable in complementary slots formed in the rear wall of the channelled upright. These support assemblies suffer from the disadvantage that if an upwardly directed load is applied accidentally to the bracket the cam members and ledge become disengaged and the support bracket is then free to slide down the upright, collapsing the assembly.

OBJECTS OF THE INVENTION

One object of the invention is to provide a support assembly for shelving in which a shelf supporting bracket is positively obtained in an upright to overcome both the horizontal and vertical components of a load force applied to the bracket.

Another object of the invention is to provide a support assembly for shelving whereby the load applied to a bracket is evenly distributed over the contact area between the bracket tongue and upright groove.

A further object of the invention is to provide a support assembly for shelving which resists any upwardly directed force applied to the bracket.

It is also an object of the invention to provide a support assembly for shelving which provides a large area of contact between the bracket tongue and upright groove to distribute the load applied.

A further object of the invention is to provide an aesthetically pleasing support assembly for shelving.

A still further object of the invention is to provide a support assembly for shelving in which the load applied to a bracket may be distributed for one shelf supporting bracket to another.

A still further object of the invention is to provide a support assembly for shelving which may be used for supporting shelves disposed at varying angles to an upright.

SUMMARY OF THE INVENTION

According to the invention there is provided a support assembly for shelving comprising an upright having an outwardly-facing channelled groove, the groove having spaced-apart front and rear retaining faces, a bracket for supporting a shelf, a tongue projecting rearwardly of the bracket, the tongue being dimensioned for confinment between the front and rear retaining faces of the groove, a reception means formed between the tongue and the upright by cutting away portion of the bottom corner of the tongue to provide an upwardly extending slot between the tongue and the rear retaining face of the groove, a pushing means for mounting within the slot to urge the lower portion of the tongue forwardly against the front face of the groove, and retaining means integral with the pushing means for preventing movement of the tongue along the upright.

Preferably, this slot is an upwardly reducing slot.

In one embodiment of the invention the pushing means and retaining means are provided by a body of resilient material, squeezed into the slot, the pushing means being provided by the resilience of the body on squeezing, and the retaining means being provided by the subsequent frictional resistance between the body and the slot.

Preferably, the body is of substantially cylindrical shape.

Advantageously, the body is a hollow body.

In another embodiment of the invention the pushing means and retaining means are provided by an elongate member for insertion into the slot at one end to provide the pushing means, adapted at its other end to rest on a support means fixed in position relative the upright to provide the retaining means.

Typically the support means is a shelf supporting bracket secured to the upright.

Advantageously the groove is an elongate groove for reception of the tongue, the tongue being slidable in the groove for height adjustment of the bracket relative the upright.

In one embodiment of the invention, the tongue is dovetail in shape for interfitting in a complementary dovetail groove.

Alternatively, the tongue is bullhead in shape for interfitting in a complementary bullhead groove.

In a further embodiment of the invention the upright includes a plurality of elontage grooves for reception of tongues disposed at varying angles thereto.

ADVANTAGES OF THE INVENTION

One advantage of the invention is that the bracket is positively retained in the upright as the horizontal component of a load force applied to the bracket is uniformly distributed over the bracket tongue and consequently the reaction forces in the upright are likewise distributed over the area of contact between the bracket and the upright. Further, the retaining means overcomes the vertical component of a load force applied to the bracket thus securing the bracket in position in the groove. The cut-out slot facilitates the urging of the tongue forwardly against the front retaining face of the upright by the pushing means.

Another advantage of the invention is that the load is evenly distributed over the contact area between the tongue and groove.

Because the pushing and retaining means is deformable it substantially fills the cut-out slot as a load force is applied to the bracket increasing the area of contact between the tongue and the retaining walls of the upright groove to urge the tongue forwardly and secure the bracket in position. Further, this arrangement also resists any upwardly directed force applied to the bracket.

A further advantage of the invention is that the cylindrical body, when deformed, substantially fills the slot between the tongue and upright for even distribution of the load applied and facilitates ease of assembly since the body may be conveniently rolled into position along the rear retaining wall of the channelled groove.

The advantage of the body being hollow is that it can more easily deform when a downwardly directed loading force is applied to the bracket. Thus, the rear retaining face of the groove and the side of the tongue bear against substantially the whole of the outer rim of the deformed hollow cylinder to provide a large area of contact between the tongue and upright and hence distribute the load.

The advantage of the pushing and retaining means being provided by an elongate member is that the friction force between the rear retaining wall of the groove coupled with the direct vertical support afforded by the additional support means overcomes the vertical component of the load force to provide the retaining means and secure the bracket in position in the upright. In addition, the elontage member covers any fixing means used for securing the upright to a wall which may otherwise be visible thus providing a particularly aesthetically pleasing support assembly.

A further advantage of the invention is that because the support means is provided by a shelf supporting bracket the vertical load applied may be distributed from one bracket to the next lower bracket. Further, different lengths of elongate member may be used to provide vertical spacing members between adjacent brackets.

Another advantage of the invention is that because the groove is an elongate groove the bracket tongue is easily slidable in the groove for height adjustment of the shelf support relative the upright and thus a single channelled upright may be used to support a plurality of shelf brackets, the brackets being slidably adjustable relative the upright by sliding the tongue in the groove.

A further advantage of the invention is that because the tongue and groove are dovetail in shape there is a large tongue to groove contact area facilitating ease of load distribution. Additionally, particularly with brackets and uprights made of hard wooden material, such grooves are relatively easily formed.

A still further advantage of an alternative embodiment of the invention is that because the tongue and groove are bullhead in shape there is a large area of contact between the tongue and groove for distribution of the load evenly over the area of contact. In addition, the bullhead shape facilitates adequate load distribution with a relatively small width of tongue and hence the bracket can be shaped from a piece of material having a relatively small thickness.

A further advantage of the invention is that because the upright includes a plurality of elongate grooves a number of brackets extending in various directions may be supported in a single upright.

These and other objects and advantages of the invention will be readily apparent from the following description of some preferred embodiments of the invention which are given by way of example only with reference to the accompanying drawings.

BRIEF DESCRIPTION OF THE DRAWINGS

FIG. 4 is a perspective view of the support assembly of FIG. 1, in assembled form.

DETAILED DESCRIPTION OF THE INVENTION

Figure 1:
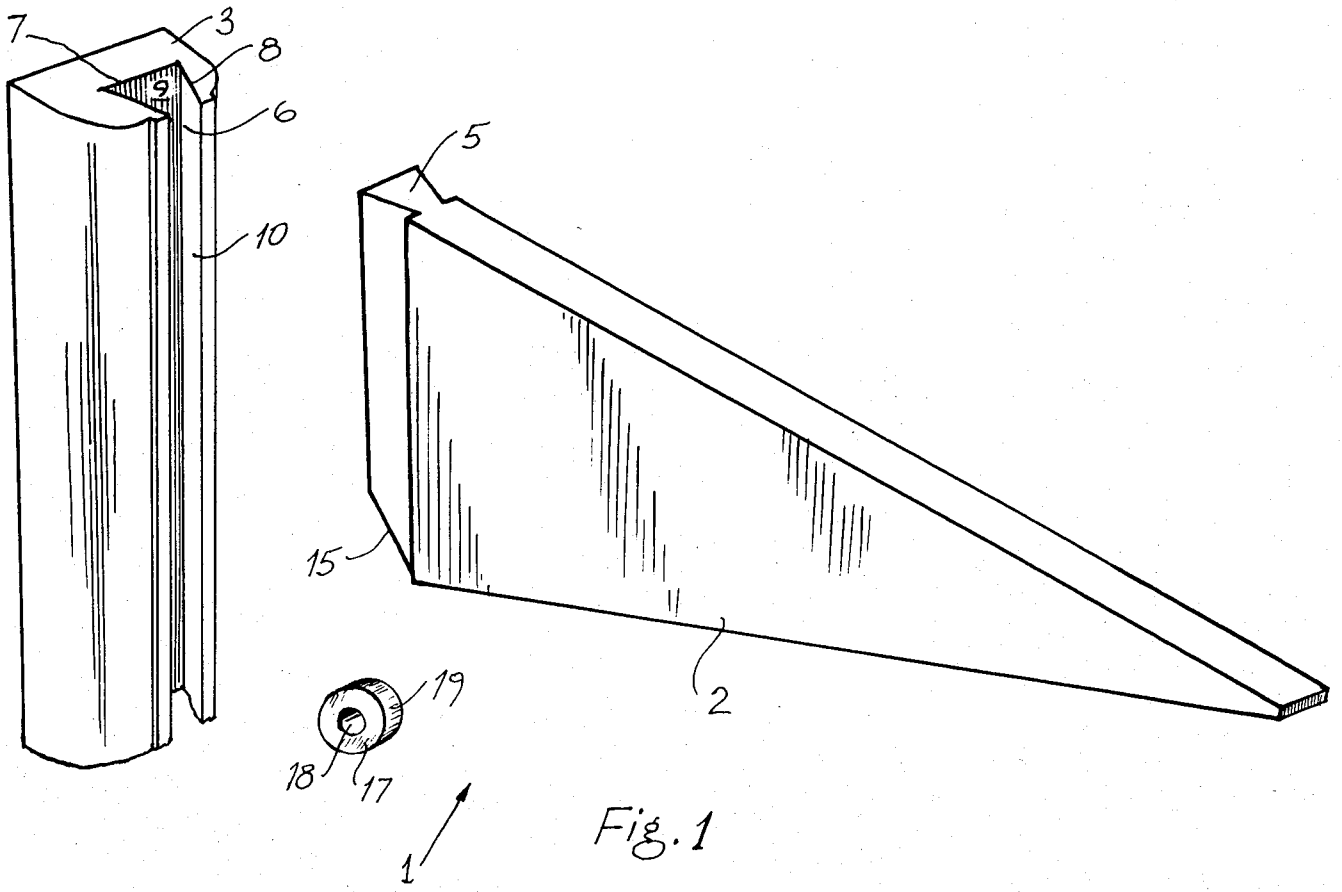
FIG. 1 is an exploded perspective view from the top of a support assembly for shelving according to the invention.

Referring to the drawings and initially to FIGS. 1 to 6 thereof, there is provided a support assembly for shelving indicated generally by the reference numeral 1 comprising a bracket 2 for supporting a shelf, and an upright 3. The bracket 2 and upright 3 are preferably made of hardwood such as mahogany but can be of any other suitable material such as plastics or metal. The bracket 2 is formed with a rearwardly projecting tongue 5 which in this case is dovetail-shaped in transverse cross-section for interfitting in a complementary outwardly facing elongate dovetail groove 6 in the upright 3. The tongue 5 of the bracket 2 is a sliding fit in the groove 6.

The groove 6 is defined by a rear retaining wall 7 and a pair of diagonal connecting walls 8 converging outwardly from the rear wall. The formal portion of the walls 8 provide front retaining faces 10 for the tongue 5. The front face of the rear wall 7 forms a rear retaining face 9 for the tongue 5. This construction of groove prevents forward displacement of the brackets 2 in the uprights 3.

The bottom corner 15 of the tongue 5 is cut-away to form, together with the rear retaining face 9 of the groove 6, an upwardly extending and in this case reducing slot 16 for reception of a pushing means for retention of the bracket 2 at a predetermined height in the upright 3. A pushing means and an integral retaining means are provided in this case by a cylindrical body 17 of deformable and resilient material such as Neoprene rubber having an outer rim 19 and an axially extending elongate hollowed out portion 18.

To assemble the joint the tongue 5 of the bracket 2 is inserted in the groove 6 at either the top or bottom end of the upright 3. The bracket 2 is then adjusted in height by sliding the tongue 5 in the groove 6 until the desired height is achieved. The cylindrical body 17 is then inserted into the groove 6 and rolled along the rear retaining face 9 in position underneath the slot 16. The bracket 2 is then pressed down on the outer rim 19 of the body 17. As the downward load is applied to the bracket 2 the body 17 is squeezed and deforms due to its resilience to provide a pushing means to substantially fill the slot 16 and urge the lower portion of the tongue 5 forwardly against the front portion of the diagonal walls 8 forming the front retaining faces 10 for the tongue 5. Frictional resistance developed between the deformed body 17 and the slot 16 provides the retaining means for preventing movement of the tongue 5 along the upright 3.

Figure 2:
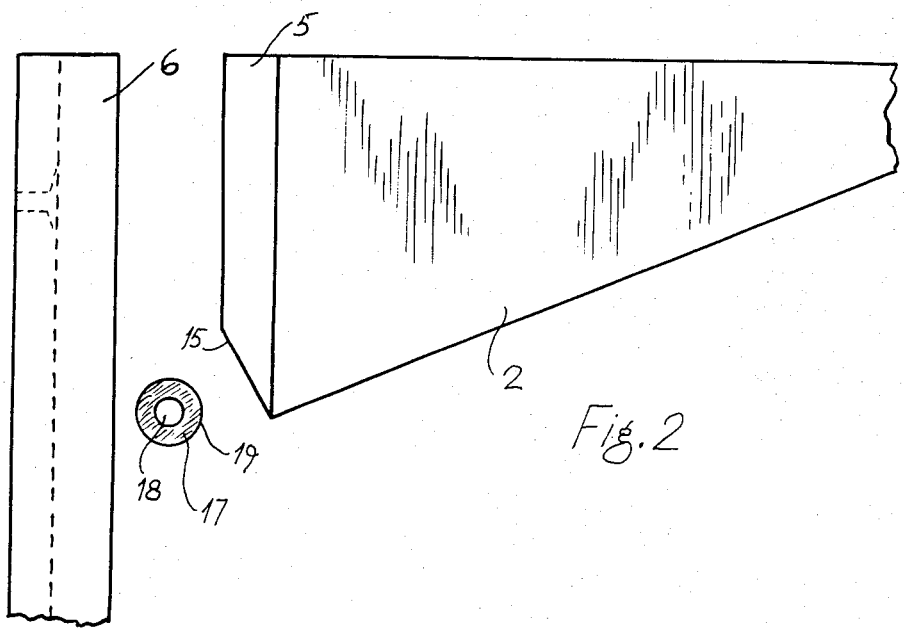
FIG. 2 is a side elevational view of the assembly of FIG. 1.
Figure 3:
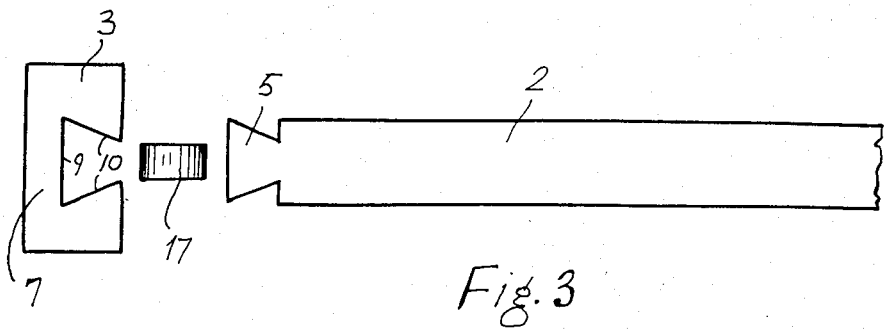
FIG. 3 is a plan view of the assembly of FIG. 1.
Figure 5:
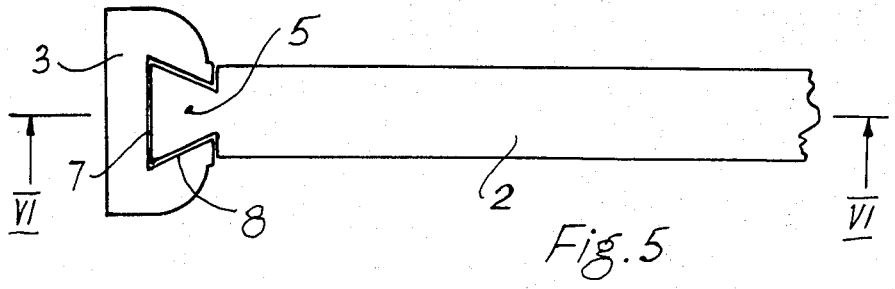
FIG. 5 is a plan view of the assembly of FIG. 4.
Figure 6:
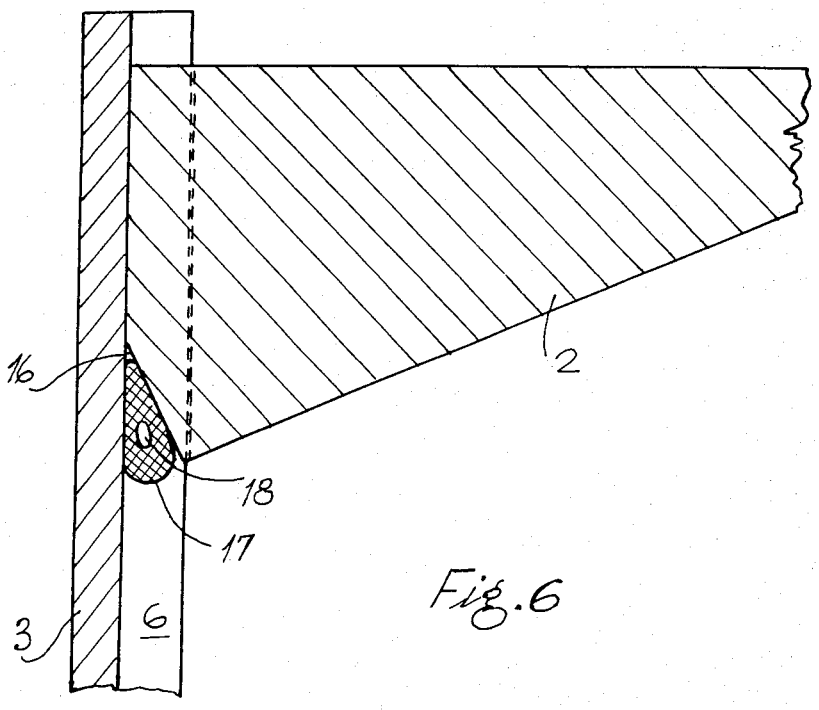
FIG. 6 is a side sectional view of the assembly of FIG. 4 taken in the direction of the arrows VI—VI in FIG. 5.

It will be appreciated that the hollowed out portion 18 of the cylindrical body 17 facilitates deformation of the body 17 to fill the slot 16 and hence provide a relatively large contact area for frictional engagement between the rear retaining wall 7 of the upright 3 and the bottom corner 15 of the tongue 5. The cylindrical body 17 thus ensures that the horizontal component of a load force applied to the bracket 2 is uniformly distributed over the interface area between the tongue 5 and groove 6. Consequently the reaction forces in the upright 3 are similarly distributed over the interface area. In addition, because of the resilience of the body and the friction forces operating between the outer rim 19 of the body, bottom corner 15 of the tongue, and the rear retaining face 9 of the upright 3. The cylinder overcomes the vertical component of the load force applied to the bracket 2 in use, thus securing the bracket 2 in position in the groove 6. It will be appreciated that because the bracket is secured in position in the upright 3 any accidentally applied upwardly directed loading force on the bracket 2 will not generally be sufficient to disengage the cylinder 17 from the slot 16. In order to release the bracket 2 such an upwardly directed force is applied to the bracket 2 adjacent the tongue 5, such as by pushing the bracket 2 upwardly or, in some cases, tapping with a mallet. As the bracket 2 is pressed upwards the deformed body 17 returns to its original cylindrical shape as shown in FIGS. 1 to 3, allowing the bracket 2 to be moved upwards. If it is desired to relocate the bracket 2 in the upright 3 the body 17 may be re-inserted and the locking procedure repeated.

It will be appreciated that many materials of construction, different shapes and/or various configurations of hollowed out portions may be employed for retaining the bracket in position in the upright. One requirement is that friction forces between the pushing means and the upright and the bottom corner of the tongue must be sufficient to overcome the vertical component of the load force. Thus, in some constructions it may be possible to dispense with the hollowed out portion and provide, for example, for increased friction forces by roughening the engagement surfaces between the pushing means and the upright and tongue.

Figure 7:
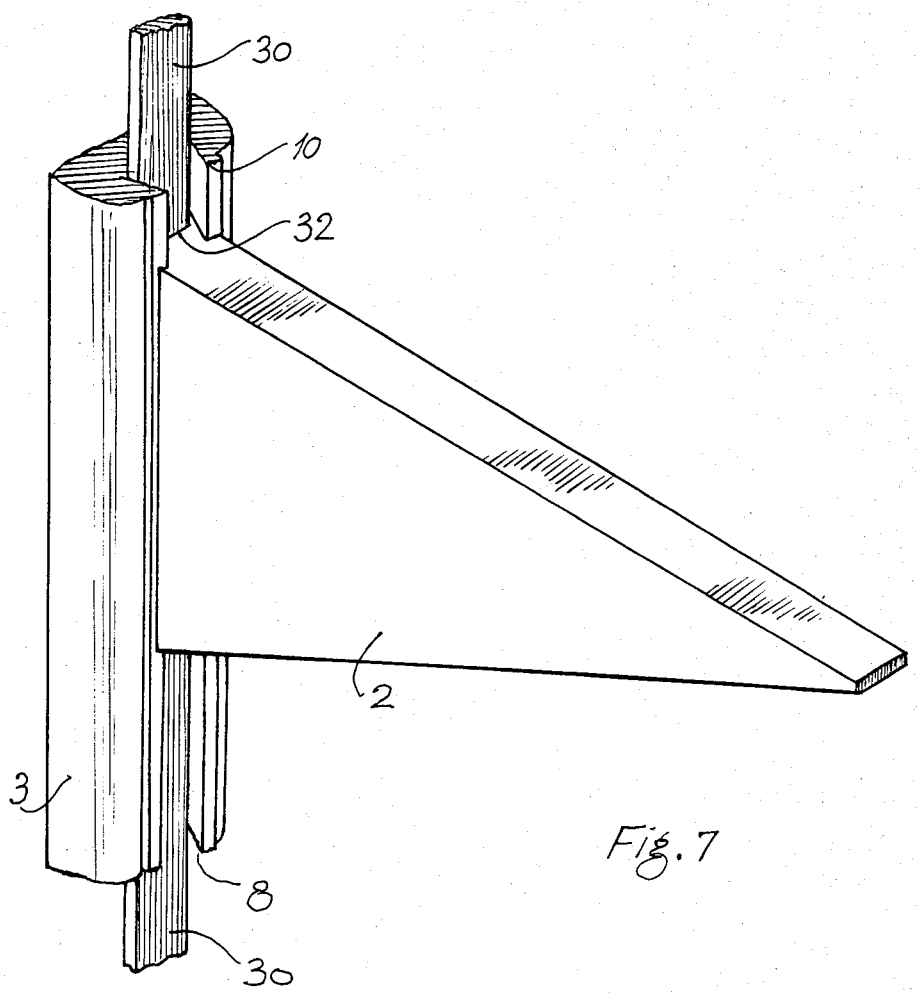
FIG. 7 is a perspective view from the side of a support assembly for shelving according to another embodiment of the invention.
Figures 8, 9:
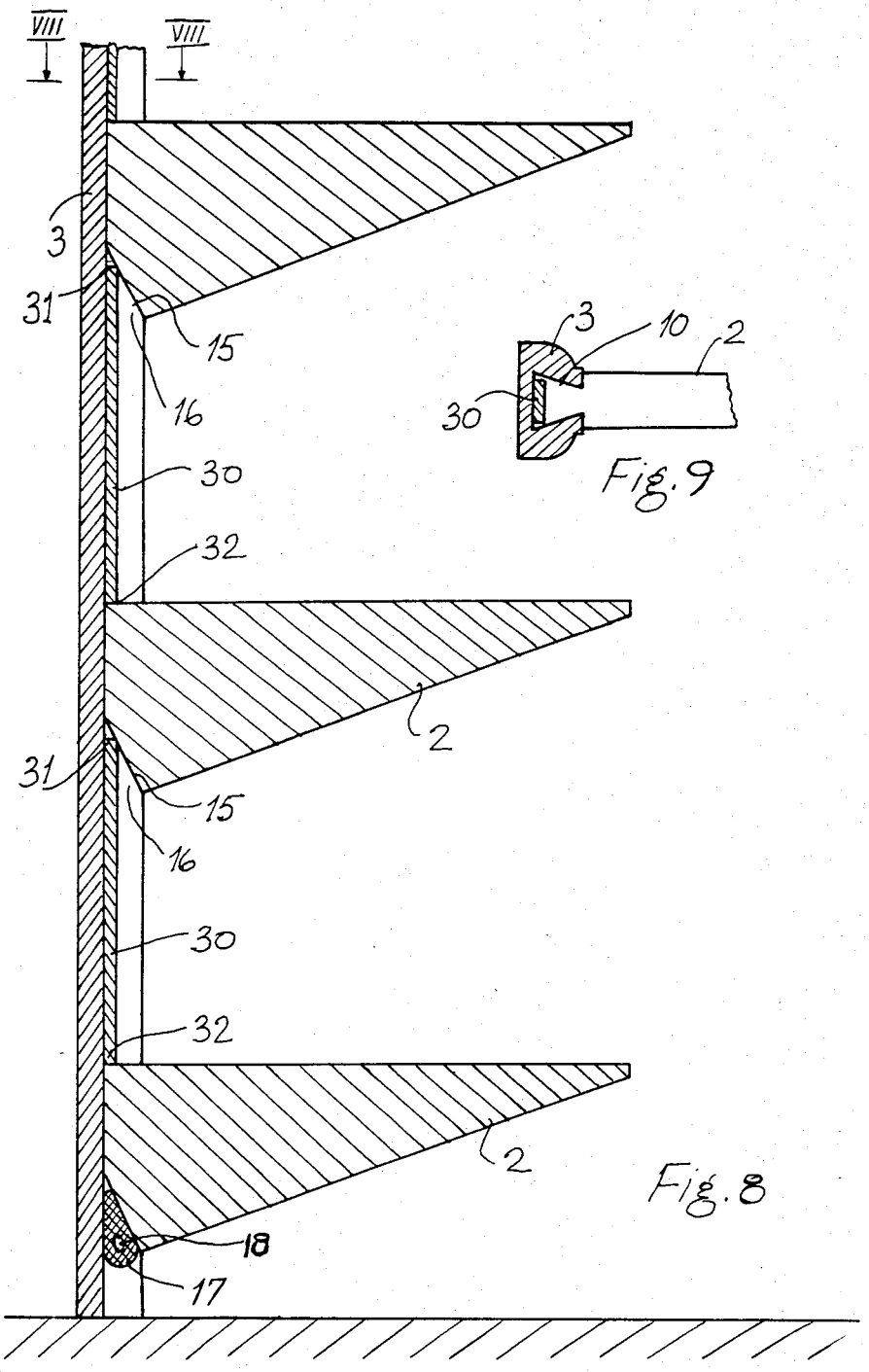
FIG. 8 is a schematic sectional view of a display shelf unit including the shelf supporting brackets and upright support members shown in FIG. 7.
FIG. 9 is a plan, partly sectional view in the direction of the arrows VIII—VIIII in FIG. 8.

Referring now to FIGS. 7 to 9 an alternative construction of support assembly for shelving in accordance with the invention is illustrated. For simplicity, parts similar to those identified with reference to FIGS. 1 to 6 are assigned the same reference numerals. In this case the pushing means and integral retaining means is provided by an elongate member 30 of hardwood material for insertion into the reducing slot 16 at one end 31 and adapted at its other end 32 to rest on a support means fixed in position relative the upright 3. In this case the support means is a shelf supporting bracket 2 fixed in position relative the upright 3 by a pushing means as described with reference to FIGS. 1 to 6. The elongate member 30 essentially forms a lath extending between adjacent brackets 2 on the upright 3. The lath is rectilinear in horizontal cross-section and is slightly less broad than the width of the rear retaining walls 7 of the groove 6 to confine the lath in the groove and prevent bending in any direction, while facilitating slidable movement of the lath in the groove.

To fit the assembly the upright 3 is first fixed to a wall by, for example, mounting screws inserted through the rear retaining wall 7 of the groove 6. The lowermost bracket 2 is then fixed in position by using a pushing means comprising the deformable cylindrical body 17 as described above with reference to FIG. 1 to 6. A length of lath 30 corresponding to the desired spacing between adjacent shelf brackets 2, with an allowance for insertion of the upper end 31 of the lath in the slot 16, is then cut. The lath 30 is inserted into the groove 6 at the uppermost end of the upright 3 and slid down the groove until the bottom end 32 engages against the top of the tongue 5 of the lowermost bracket 2. The tongue 5 of the next upper bracket 2 is inserted in the groove 6 at the uppermost end of the upright 3 and slid down the groove until the upper end 31 of the lath 30 engages in the slot 16 formed between the bottom corner of the tongue 5 and the rear retaining face 9 of the upright 3. The bracket 2 is then pressed downwardly to jam the upper end 31 of the lath 30 in the slot 16. Another length of lath 30 is then cut and inserted in the groove and a further bracket inserted in the upright. If it is desired to have the same spacing between adjacent brackets laths may be pre-cut to the desired length.

In this case the upper end 31 of the lath 30 pushes the bottom portion of the bracket 2 forwardly against the front retaining faces 10 of the groove 6 to uniformly distribute the horizontal component of a load applied to the bracket over the interface area between the tongue and bracket and hence provide the pushing means. The reaction forces in the upright are likewise distributed over the interface area between the bracket and the upright groove. The friction forces between the lath and the rear retaining face 9 of the groove are not generally sufficient of themselves to overcome the vertical component of the load force applied to the bracket 2.

The friction forces however, are assisted in that the other end 32 of the lath 30 rests on a bracket 2 which is fixed in position in the upright 3. Thus the pushing means urges the lower portion of the tongue 5 of the bracket 2 forwardly against the front retaining faces of the groove 6 and the retaining means prevents movement of the tongue 5 along the upright 3.

It will be appreciated that this construction of pushing and retaining means is particularly advantageous from an aesthetic point of view in that the lath 30 presents a continuous uninterrupted flat surface which conceals the heads of any screws that may be used for fixing the upright to a wall. In addition, the lath 30 may be used as an in-lay piece in the upright to conceal the fixing screws.

Figure 10:
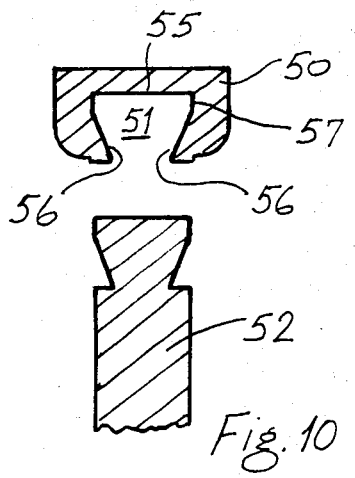
FIG. 10 is a view in horizontal cross-section of a modified shelf supporting bracket and upright.

Referring now to FIG. 10 a modified upright 50 having an elongate channelled groove 51 and shelf supporting bracket 52 having a rearwardly projecting tongue 53 is illustrated. In this case, the groove 51 and tongue 53 are bullhead in shape. The groove 51 is defined by a rear retaining wall 55, diagonal walls 56 and connecting walls 57 joining the rear and diagonal walls 55, 56. The diagonal walls 56 converge outwardly at any angle of 26° to the vertical. This tongue and groove section is particularly advantageous in that for given load conditions the bracket and upright of bullhead shape can be formed from material of lesser thickness than a dovetail shape tongue and groove and which is capable of withstanding similar load forces. In addition, the converging angle of the dovetail tongue and groove generally lies between 10° and 14°, however, with a bullhead shape groove this angle can be increased up to 36° if required.

Further, the addition of the connecting walls 57 facilitate the distribution of load applied.

Figure 11:
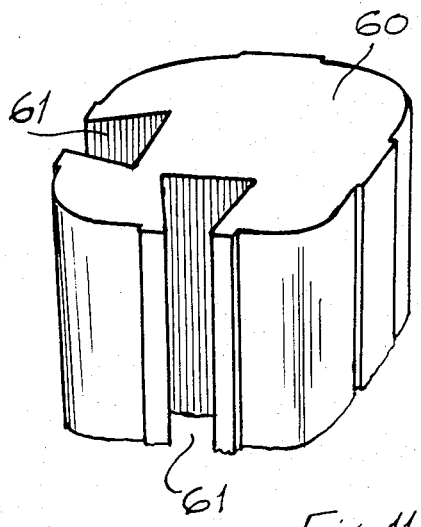
FIG. 11 is a perspective view of a two-way upright.
Figure 12:
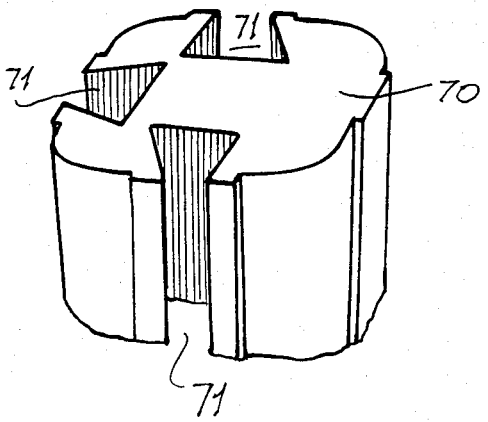
FIG. 12 is a perspective view of a three-way upright.
Figure 13:
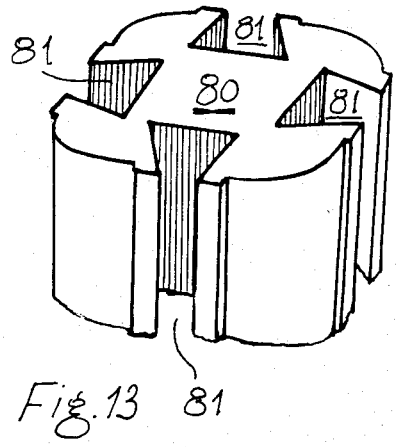
FIG. 13 is a perspective view of a four-way upright.

Referring now to FIGS. 11 to 13 various alternative constructions of uprights are shown which facilitate the use of a single upright for a number of brackets disposed at varying angles thereto. FIG. 11 shows a bracket 16 with two dovetail shape cut-out elongate grooves 61 in adjacent sides of the upright 60. This construction of upright may be used for two sets of brackets at right angles to each other such as may be used as a corner piece.

An upright 70 having three elongate dovetail grooves 71 is illustrated in FIG. 12 for use with brackets disposed at right angles to three sides of the upright 70.

An upright 80 having four elongate dovetail grooves 81 in each of four sides of the upright 80 is illustrated. Again, brackets may be disposed in each of the grooves.

Many other similar constructions of upright with a plurality of elongate grooves disposed at varying angles to the upright will be readily apparent to those skilled in the art.

The uprights just described with reference to FIGS. 11 to 13 may be used not only on conjunction with shelf supporting brackets but also in the assembly of other furniture units such as tables or chairs. For example, the upright illustrated in FIG. 11 may be used for the leg of a chair, chair supports having rearwardly projecting dovetail tongues being inserted in the grooves as will be apparent from the drawings.

Figure 14:
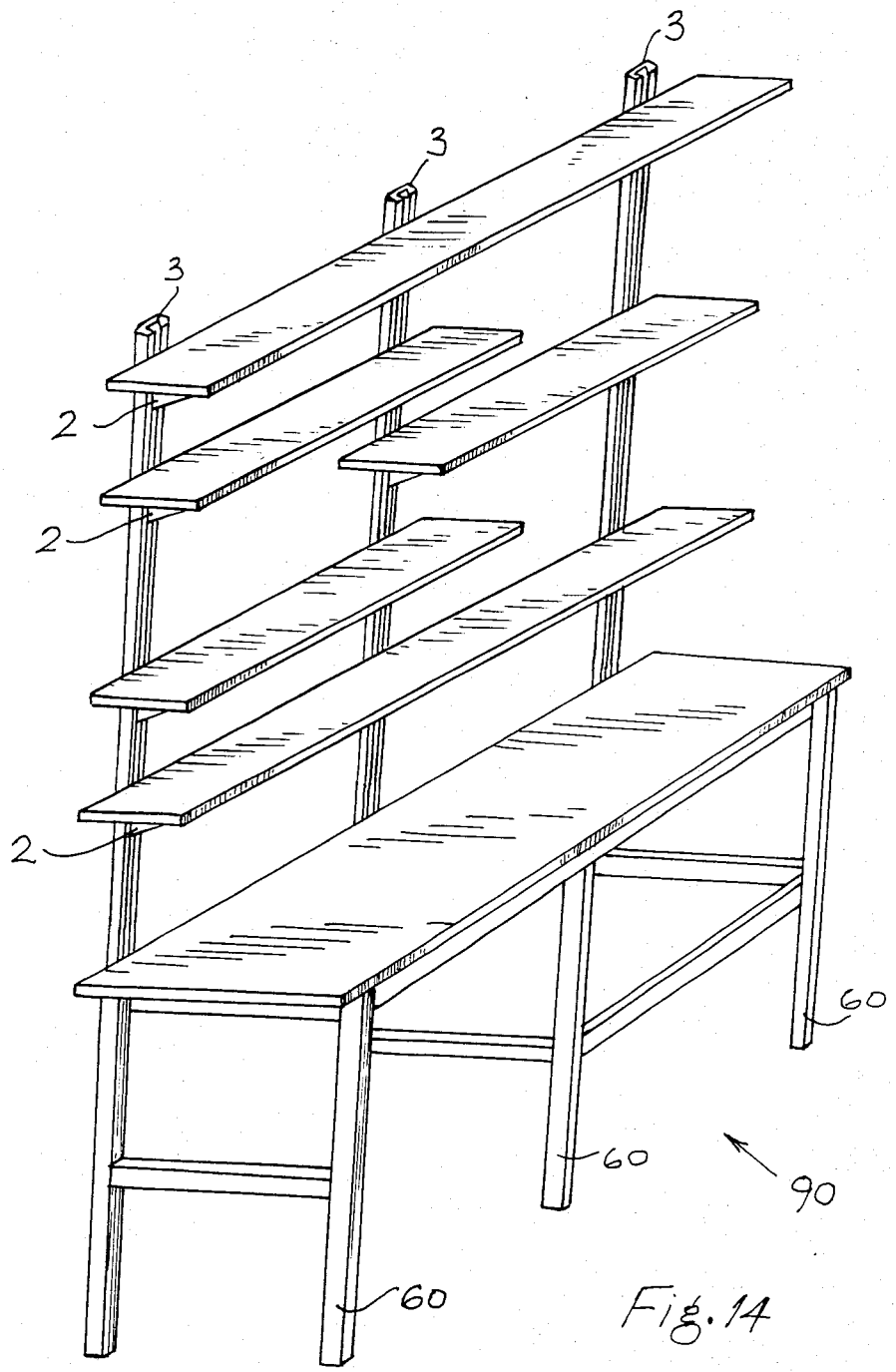
FIG. 14 is a schematic perspective view of a display shelf unit including a plurality of shelves supported on brackets in upright supporting members.

Referring particularly to FIG. 14 one example of a furniture unit indicated generally by the reference numeral 90 built up from the assemblies just described is illustrated.

It is envisaged that any tongues and grooves of suitable cross-section may be employed other than the dovetail and bullhead shapes illustrated. Particularly envisaged are channelled-shaped tongues and grooves such as are conventionally used for adjustable shelving and racking. It is essential however, that the groove includes both front and rear retaining faces, the front retaining face being defined either by portion or all of diagonal converging walls or front flanges provided on the channel.

It will be appreciated that as an alternative to a cut-away in the bottom corner of the bracket tongue the cut-away could be provided in the rear retaining wall of the groove in the upright. A plurality of these cut-outs being spaced-apart along the wall. Pushing and means such as described with reference to FIGS. 1 to 6 would again be required for retaining the bracket in position relative the upright.

It is also envisaged that while the slot has been described as a reducing slot any construction of upwardly extending slot may be employed such an an upwardly increasing slot or a slot having the same width from uppermost to lowermost end.

It will be appreciated that the support means may be provided by a shelf supporting bracket locked in position in the upright by a washer adjacent the head of an upright fixing screw, the washer jamming in the slot to lock the bracket.

I claim:

1. A support assembly for shelving comprising:

an upright having an outwardly-facing channelled groove, the groove having spaced-apart front and rear retaining faces, a bracket for supporting a shelf, a tongue projecting rearwardly of the bracket, the tongue being dimensioned for confinment between the front and rear retaining faces of the groove, a reception means formed between the tongue and the upright by cutting away portion of the bottom corner of the tongue to provide an upwardly extending slot between the tongue and the rear retaining face of the groove, a wedging member mounted within the slot, between a rear face of the groove and a front face of the cut-away bottom of the tongue, to urge the lower portion of the tongue forwardly against the front face of the groove to distribute the horizontal component of a load force applied to the bracket over the interface area between the tongue and groove and to resist the vertical component of the load force.

2. A support assembly as claimed in claim 1 wherein the slot is an upwardly reducing slot.

3. A support assembly as claimed in claim 1 wherein the wedging member is provided by a body of resilient material, squeezed into the slot, the resilience of the body on squeezing urging the lower portion of the tongue forwardly against the front face of the groove to resist the horizontal component of the load force, and the subsequent frictional resistance between the body and the slot resisting the vertical component of the load force.

4. A support assembly as claimed in claim 3 wherein the body is of substantially cylindrical shape.

5. A support assembly for shelving as claimed in claim 3 wherein the body is a hollow body.

6. A support assembly as claimed in claim 1 wherein the wedging member is provided by an elongate member for insertion into the slot at one end to urge the lower portion of the tongue forwardly against the front face of the groove to resist the horizontal component of the load force, and adapted at its other end to rest on a support means fixed in position relative the upright to resist the vertical component of the load force.

7. A support assembly as claimed in claim 6 wherein the support means is a shelf supporting bracket secured to the upright.

8. A support assembly as claimed in claim 1 wherein the groove is an elongate groove for reception of the tongue, the tongue being slidable in the groove for height adjustment of the bracket relative the upright.

9. A support assembly as claimed in claim 1 wherein the tongue is dovetail in shape for interfitting in a complementary dovetail groove.

10. A support assembly as claimed in any preceding claim wherein the tongue is bullhead in shape for interfitting in a complementary bullhead groove.

11. A support assembly as claimed in claim 1 wherein the upright includes a plurality of elongate grooves for reception of tongues disposed at varying angles thereto.

12. A support assembly according to claim 1 wherein the entire wedging member is completely disposed within the groove.

13. A support assembly according to claim 1 wherein lateral cross sections of the tongue and the channel forming the groove have complementary shapes, and the tongue closely fits in the groove.

* * * * *